United States Patent [19]

Kaes

[11] 4,208,864

[45] Jun. 24, 1980

[54] TUBE STRANDING MACHINE

[75] Inventor: Günter Kaes, Xanten, Fed. Rep. of Germany

[73] Assignee: Fried. KRUPP Gesellschaft mit beschränkter Haftung, Essen, Fed. Rep. of Germany

[21] Appl. No.: 910,579

[22] Filed: May 30, 1978

[30] Foreign Application Priority Data

May 28, 1977 [DE] Fed. Rep. of Germany ..... 2724419

[51] Int. Cl.[2] ..... D07B 7/06; D07B 3/02

[52] U.S. Cl. ..... 57/58.34; 57/58.72

[58] Field of Search ..... 57/58.32–58.38, 57/58.72, 58.81, 64, 127.5, 127.7, 58.74, 58.76, 58.78, 58.79

[56] References Cited

U.S. PATENT DOCUMENTS

| | | | |
|---|---|---|---|
| 6,753 | 10/1849 | Clark | 57/58.81 X |
| 1,900,310 | 3/1933 | Somerville | 57/58.81 X |
| 2,463,887 | 3/1949 | Langstreth | 57/58.81 X |
| 2,717,485 | 9/1955 | Pearce | 57/58.32 |
| 2,731,786 | 1/1956 | Klein | 57/58.76 X |
| 2,860,479 | 11/1958 | Wheater | 57/127.7 X |
| 3,264,813 | 8/1966 | Mackie | 57/58.76 |
| 4,079,580 | 3/1978 | Varga | 57/127.5 |

*Primary Examiner*—John Petrakes

*Attorney, Agent, or Firm*—Becker & Becker, Inc.

[57] ABSTRACT

A tube stranding machine with spool carriers which are coaxially arranged with the rotor and are rotatable relative thereto, spools being arranged in the spool carrier. Each spool carrier is provided with at least one eccentrically arranged displaceable weight adapted by displacement thereof in case of a determinable turning movement of the spool carrier to compensate for the unbalance of the spool carrier.

6 Claims, 7 Drawing Figures

TUBE STRANDING MACHINE

The present invention relates to a tube stranding machine with spool carriers and spools mounted therein, said spool carriers being rotatably arranged in the central axis of the rotor and opposite thereto and being provided with at least one eccentric weight. With these stranding machines which are also known as high speed stranding machines, the rotor of which is designed as tube, cage, yoke, or the like, the center of gravity of spool carriers with spools are at a lower level than the central axis in order to hold the spool carrier in the horizontal position. This can be realized either by arranging the spool center point below the central axis or by providing an additional counter weight on the spool carrier. The last mentioned arrangement is the more customary one. By locating the center point of gravity of the spool carrier with the inserted spool lower than the central axis, the advantage will be realized that with rotating rotor, spool carrier and spool remain at a standstill in the horizontal position and do not rotate with the rotor. This has the advantage that the return rotation necessary for many stranding materials is created and unbalances do not occur which would otherwise due to irregular winding of the coils limit the speed of rotation of the rotor.

With these machines, however, in practice problems have been encountered with regard to safety of operation and safeguarding against accidents by upsetting spool carriers from which the spools could fly out and cause considerable damage. The upsetting may be caused by blocking ball bearings or by wires getting hooked up Inasmuch as the rotors rotate at relatively high speeds, a freed spool has a considerable kinetic energy so that outer protective wrappings of a known type will not suffice to prevent accidents. Incidents have become known in which the off flying coil has torn the entire rotor out of its anchoring. Regulations were considered for the operators of such machines which would force a reduction in the speed of the machine. This, however, would amount to considerably affecting the economy of such machines the greatest advantage of which is seen in the high speed machines. To avoid dangerous effects of the upsetting and of the turning of the spool carrier, heretofore known machines were equipped with safety switches, especially pendulum switches, which at an undue inclination of the spool carrier outside the horizontal plane, turn off the machine. The effect of such switches, however, is unsatisfactory because in case of a sudden bearing blockage or when the wire becomes snagged up, the time from such an incident till the machine comes to a standstill after a complete braking is still too long (about six seconds with a machine of customary size) to safely prevent the coil from flying out.

It is, therefore, an object of the present invention to provide a tube stranding machine of the above mentioned general type which, when the coil carrier becomes upset, will be accident proof.

These and other objects and advantages of the invention will appear more clearly from the following specification in connection with the accompanying drawings, in which.

Figure 7:
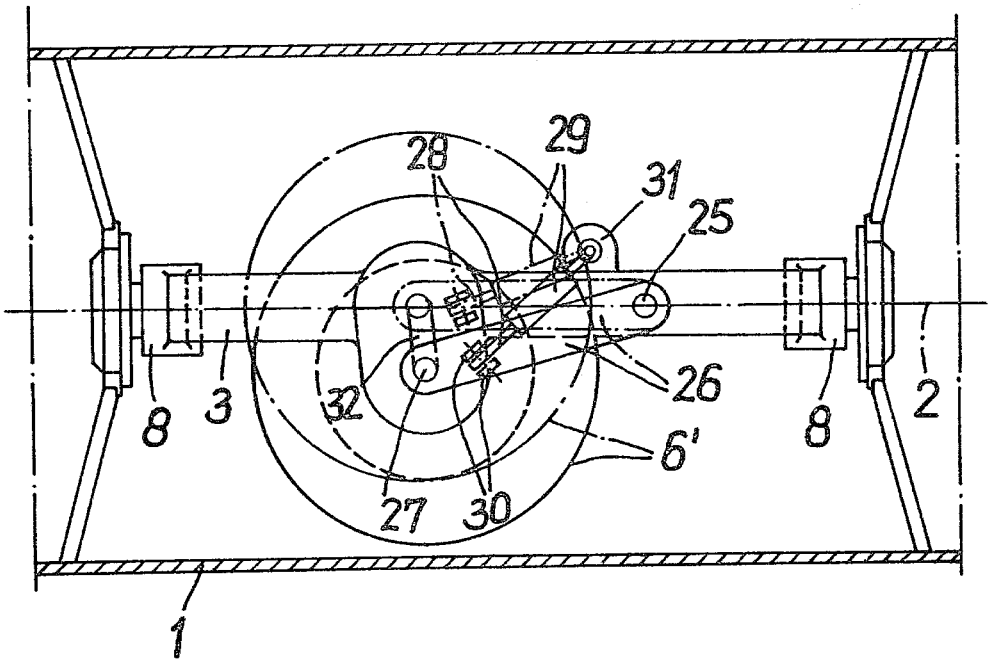

FIG. 7 diagrammatically illustrates the displacement of the balancing weight in the high speed stranding machine according to the invention.

The tube stranding machine according to the present invention is characterized primarily in that each spool carrier is provided with at least one displaceable weight which due to its displacement in case of a turning movement of the spool carrier neutralizes its unbalance.

Since, according to the present invention, due to the fact that in case of an upsetting of the spool carrier, no unbalance is created and thus no destroying mass forces can be freed, the spool carrier can likewise rotate without danger until the rotor has been stopped. Consequently, with the structure according to the invention, the spool carrier need not be dimensioned as strong as spool carriers which in view of safety requirements have to be dimensioned very strong. Furthermore, the harmful results exerted by the unbalance as a result of the upsetting of the spool carrier and its effect upon the rotor and its mounting will not occur.

The device according to the present invention is particularly advantageous when the coil carrier provided with a fixed eccentric weight is provided with an additional displaceable weight which in the rest position of the coil carrier is arranged in the central axis of the rotor. In this connection, it is particularly advantageous when the additional displaceable weight is pivotable about an axis transverse to the central axis. In this way, the unbalance on the spool carrier is directly and safely eliminated in a most simple manner by the centrifugal force itself.

Referring now to the drawings in detail, spool carriers 3 are arranged in the rotor 1 and more specifically in the central axis 2 thereof. Rotatably mounted in said spool carriers 3 are spools 6 which are safely held therein by locks 5 (Pinolenverschlüsse) provided with manually operable levers 4. When the rotor 1 rotates about its axis 2, the spool carriers 3 are held in their horizontal rest position. The weight 7 creates the counter weight necessary therefor for compensating for the bearing friction in the bearing 8 and for the compensation of the withdrawing forces created by the wire (not illustrated) delivered by the spool 6.

Figure 1:
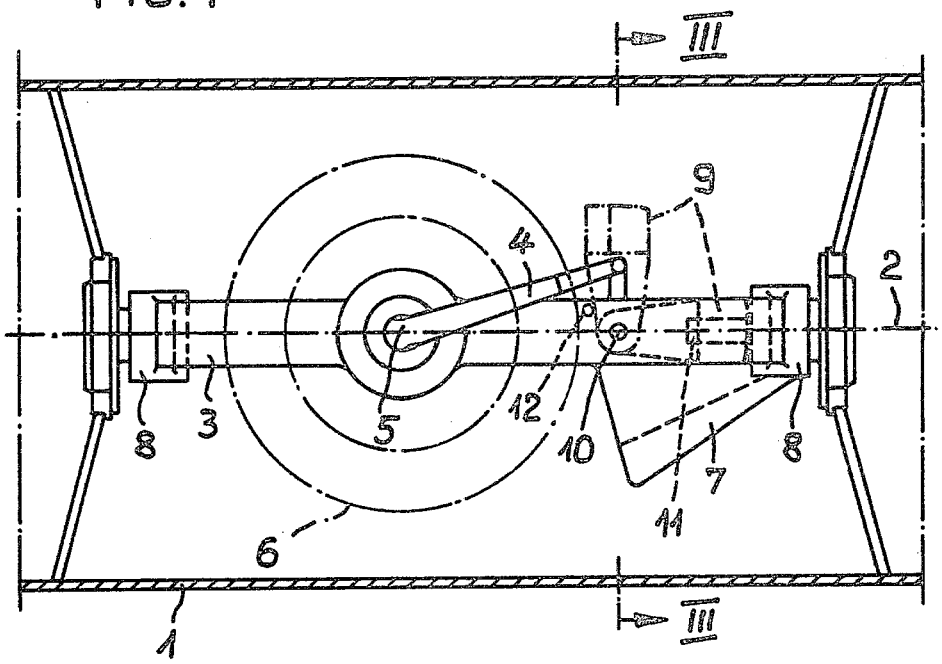
FIG. 1 is a longitudinal section of a portion of a high speed stranding machine according to the invention with a spool carrier shown in view.
Figure 3:
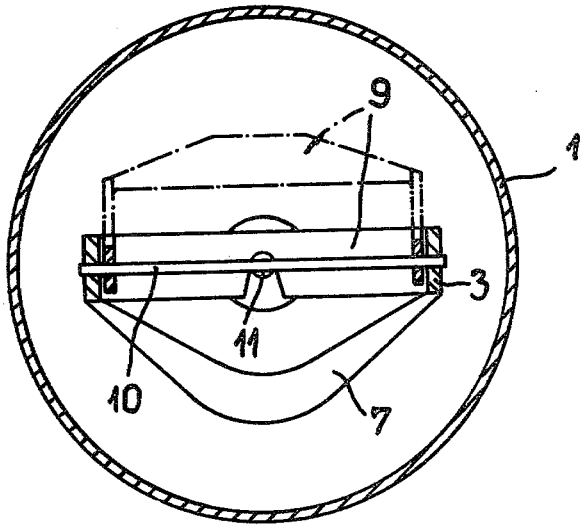
FIG. 3 represents a section taken along the line III-III of FIG. 1.

A displaceable weight 9 which is pivotable about an axle 10 and is connected thereto, in its normal condition rests on a cylindrical abutment of the spool carrier 3. The cylindrical abutment 11 is coaxial with the central axle 2 on which the axle 10 is vertically arranged. The weight 9 is normally located with its center of gravity only slightly above the central axle 2. If, however, due to some circumstances, the spool carrier 3 is upset or rotates, the weight 9 is thrown radially outwardly, and its dot-dash illustrated position in FIGS. 1 and 3 is arrested by two abutments 12, and its weight force is so dimensioned that it precisely forms the counter moment to the weight 7 whereby after an upsetting, the spool carrier represents a balanced system. Arranged on the spool carrier 3 is a known pendulum switch which, when being upset, emits the order to shut off the machine. The pendulum switch is gauged for a respective expedient turning angle of the upsetting action.

Figure 2:
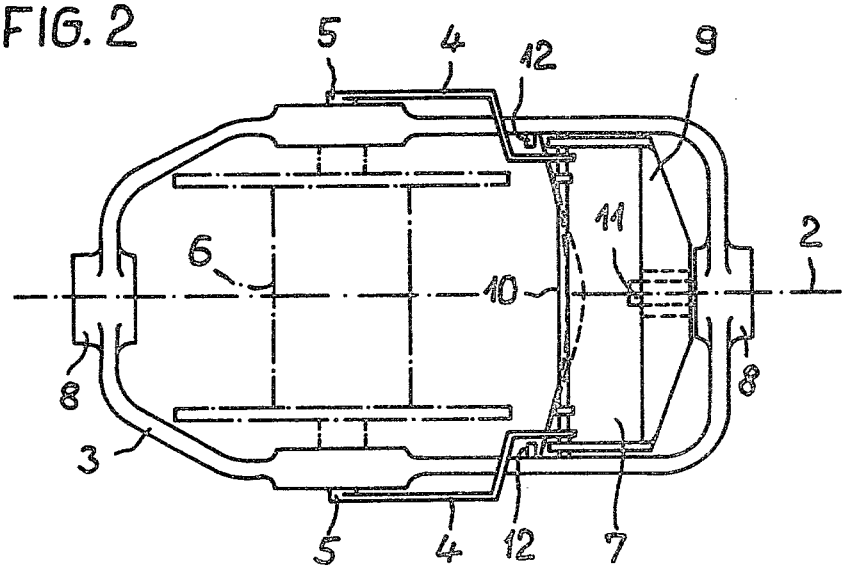
FIG. 2 is a top view of the spool carrier according to FIG. 1.
Figure 6:
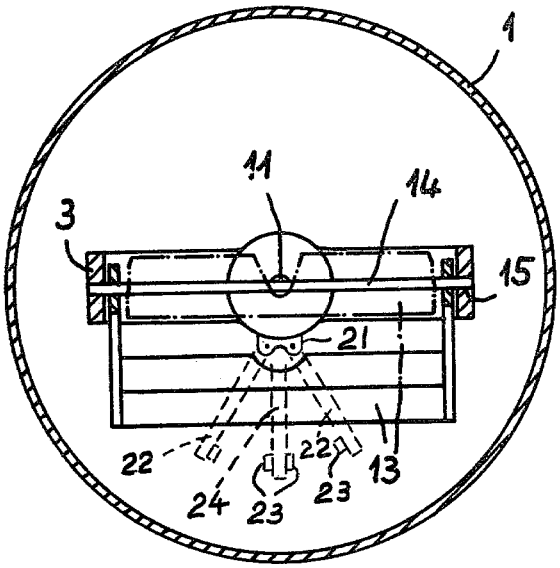
FIG. 6 represents a section taken along the line VI-VI of FIG. 4.
Figure 4:
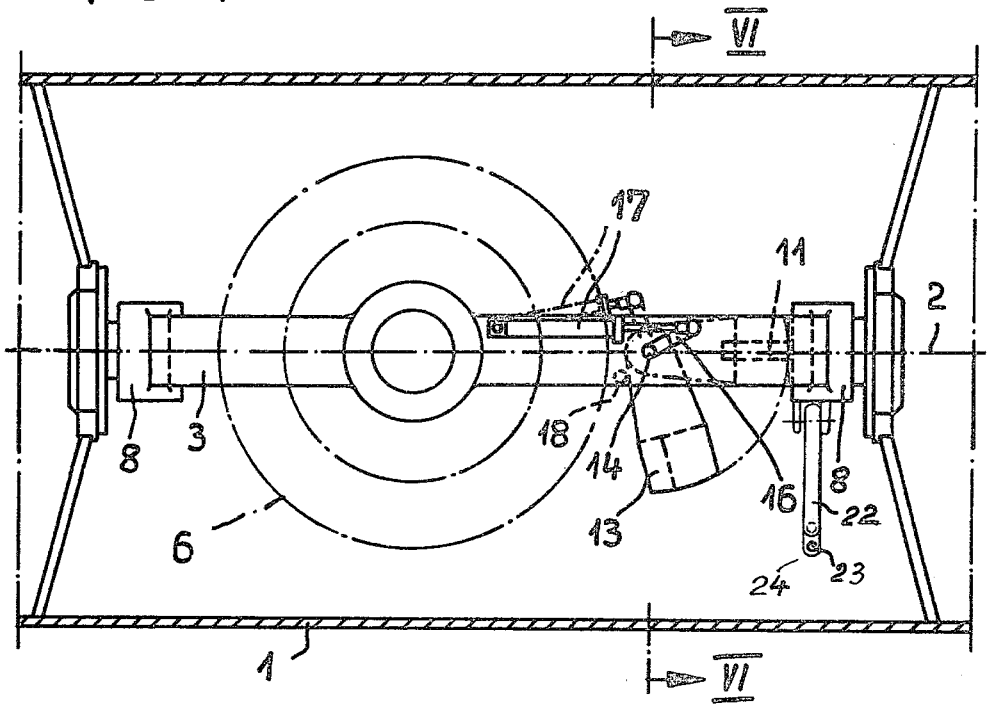
FIGS. 4 and 5 show respectively in longitudinal section and in top view another embodiment of a spool carrier according to the invention.

As to the determination of the turning angle, the most expedient turning angle in the respective instance is selected. This depends on the various embodiments of the article according to the present invention. With reference to FIGS. 4 and 6, it will be seen that a pendulum switch is provided. Fixed arms 22 which are adjustable about their center of rotation are each provided with a contact 23. Between these arms 22, there is arranged the pendulum 24 which is likewise provided with contacts 23. The angle between the pendulum in its rest position and the two arms 22 amounts in this instance to 30°. If now the spool carrier 3 turns in one of the two directions by 90°, the contacts 23 engage each other and emit a pulse for the actuation of the power cylinder 17 which thus displaces the weight 13 to its central position. 30° is thus a practical value for the turning to be ascertained. In the above instance, the weight is actuated by a hydraulic power cylinder in other words a power machine. The other possibility of displacing a weight and illustrated in the embodiments of FIGS. 1–3, however, does not require such a power machine. In this instance, the displacement is effected in a most simple manner, namely by centrifugal force. For this reason, this embodiment is preferred, especially because it has a greater safety inherent thereto. The angle of rotation at which the weight pivots out (between the start and the end of the operation a further angle of rotation is added), will in this instance depend on the selected construction and the friction in the bearings. A critical angle of rotation does not exist in this instance.

Figure 5:
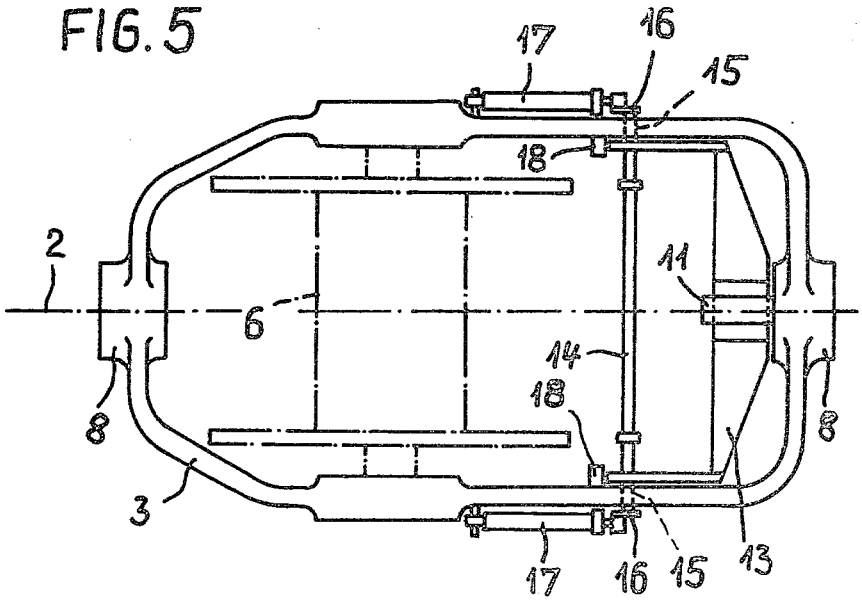

With the embodiment according to FIGS. 4–6, the spool carrier 3 is provided with only one foldable weight 13, the normal position of which is the eccentric position shown in FIGS. 1 and 3. The weight 13 comprises a shaft 14 which is passed through bores 15 of the spool carrier 3. Connected to the two ends of shaft 14 are respectively two lever arms 16 respectively engaged by a pneumatic power operable cylinder piston system 17. Two abutments 18 hold the weight 13 in its normal position. In case of an upsetting of the spool carrier 3, the power operable cylinder piston systems 17 are by a non-illustrated light barrier 20 so actuated that the weight 13 tilts inwardly and, as illustrated in FIG. 5, abuts the cylindrical abutment 11 of the spool carrier 3 as a result of which the unbalance of the spool carrier is eliminated.

More specifcally, referring to FIG. 7 which more fully explains the displacement of the eccentric weight 13 which in this instance is replaced by the spool 6', it will be seen that a lever 26 pivotal about the axle or pin 25 carries at its other end the pin or axle 27 of the spool 6'. To the outside of lever 26, the end of the piston rod 28 of hydraulic power cylinder 29 is pivotally connected between two eyes 30. The other end of the hydraulic power cylinder 29 is pivotally supported by an eye 31 arranged on the spool carrier 3. If now the hydraulic power cylinder 29 for instance actuated by a non-illustrated light barrier in other words, has been moved in, the spool 6' is displaced from its illustrated eccentric position to the dot-dash illustrated position in the center of the spool carrier 3 so that the axis of coil 6' crosses the central axis 2.

It is, of course, to be understood that the present invention is, by no means, limited to the specific showing in the drawings, but also comprises any modifications within the scope of the appended claims. Thus, other embodiments of the invention are possible which can, also belatedly, be easily adapted to the respective design of the stranding machine. When the machine instead of pneumatically operable spindle locks (Pinolenverschlüsse) has electrically operable locks, it is possible and expedient instead of the power operable cylinder piston systems 17 to employ electromagnetic adjusting devices. Similarly, an electric or permanent magnetic locking may be employed, for instance of the inwardly folded weight 13. Instead of a tilting of the weight, the weight may also be displaced in at least one guiding means. This is particularly advantageous when the coil is designed as inwardly displaceable weight.

What I claim is:

1. A high speed tube stranding machine which includes in combination: a rotor having an axis, a horizontally positioned spool carrier coaxially arranged with said rotor and rotatable relative thereto about said axis and adapted to receive and support a spool which can upset to cause danger of damage during turning movement of the spool carrier, and having a counterbalancing weight system to dispose the center of gravity of the spool carrier on one side of the axis of rotation of said spool carrier, said weight system including a displaceable weight movable about an axis transverse to said axis of rotation of the spool carrier and into a position to dispose the center of gravity of said spool carrier on said axis of rotation thereby to preclude turning movement of the spool carrier without stopping thereof, and to assure elimination of danger of damage in the event of turning movement of the spool carrier.

2. A machine in combination according to claim 1, which includes a fixed eccentric weight associated with said spool carrier kept in position by gravity, and in which said displaceable weight is movable from a rest position to an unbalance compensation working position, said last mentioned displaceable weight when in its rest position being coaxial with said rotor.

3. A machine in combination according to claim 1, in which said weight system consists of only one eccentric weight movable into a rest position in which said one eccentric weight is coaxial with said rotor.

4. A high speed tube stranding machine which includes in combination: a rotor having an axis, a horizontally positioned spool carrier coaxially arranged with said rotor and rotatable relative thereto and adapted to receive and support a spool which can upset to cause danger of damage during turning movement of the spool carrier, and at least one displaceable weight arranged directly on said spool carrier and arranged to occupy a working position eccentrically with regard to said spool carrier, said weight being operable in case of a determinable turning movement of said spool carrier to compensate for the unbalance of said spool carrier thereby to preclude damage due to turning movement of the spool carrier without stopping thereof though assuring elimination of danger of damage due to turning movement of the spool carrier, said spool carrier being provided with only one eccentric weight movable into a position in which said one eccentric weight is coaxial with said rotor, and adjusting means for pivoting said one eccentric weight about an axis transverse to the central longitudinal axis of said rotor.

5. A machine in combination according to claim 4, in which said adjusting means includes a pressure operable cylinder piston system.

6. A machine in combination according to claim 4, which includes a safety turn-off switch coupled to said adjusting means for actuating the latter.

* * * * *